US011162294B2

(12) United States Patent
Fujita et al.

(10) Patent No.: US 11,162,294 B2
(45) Date of Patent: Nov. 2, 2021

(54) DOOR CONTROL DEVICE

(71) Applicant: FUJI ELECTRIC CO., LTD., Kanagawa (JP)

(72) Inventors: Kenji Fujita, Chiba (JP); Atsushi Kitabata, Mie (JP)

(73) Assignee: FUJI ELECTRIC CO., LTD., Kawasaki (JP)

( * ) Notice: Subject to any disclaimer, the term of this patent is extended or adjusted under 35 U.S.C. 154(b) by 92 days.

(21) Appl. No.: 16/364,662

(22) Filed: Mar. 26, 2019

(65) Prior Publication Data

US 2019/0218848 A1 Jul. 18, 2019

Related U.S. Application Data

(63) Continuation of application No. PCT/JP2017/037427, filed on Oct. 16, 2017.

(51) Int. Cl.
*B61D 19/02* (2006.01)
*E05F 15/79* (2015.01)
(Continued)

(52) U.S. Cl.
CPC ..... *E05F 15/79* (2015.01); *B61D 19/02* (2013.01); *E05B 85/00* (2013.01); *E05F 15/655* (2015.01);
(Continued)

(58) Field of Classification Search
CPC ..... E05F 15/79; E05F 15/655; E05F 15/659; E05F 15/635; B61D 19/02; B61D 19/005;
(Continued)

(56) References Cited

U.S. PATENT DOCUMENTS 6,667,591 B2 * 12/2003 Mullet ..... G05B 19/042 318/445
7,576,504 B2 * 8/2009 Mullet ..... E05F 15/41 318/445
(Continued)

FOREIGN PATENT DOCUMENTS

JP H11-165635 6/1999
JP 3597767 B2 * 12/2004
(Continued)

OTHER PUBLICATIONS

International Search Report dated Jan. 16, 2018 with respect to No. PCT/JP2017/037427.
(Continued)

*Primary Examiner* — Donald J Wallace
*Assistant Examiner* — Daniel M. Robert
(74) *Attorney, Agent, or Firm* — IPUSA, PLLC

(57) ABSTRACT

A door control device includes: an electric motor control unit configured to drive, in response to a closing command for closing a door that is driven to be opened and closed by an electric motor, the electric motor; a door closed state detection unit configured to detect a closed state of the door; and a lock command output unit configured to output a lock command to lock a locking device of the door, upon the closed state being detected when a predetermined waiting time has passed after the electric motor was driven by the electric motor control unit in response to the closing command and the closed state was detected by the door closed state detection unit.

6 Claims, 7 Drawing Sheets

(51) Int. Cl.

| | |
|---|---|
| ***E05F 15/655*** | (2015.01) |
| ***E05F 15/659*** | (2015.01) |
| ***E05B 85/00*** | (2014.01) |
| ***B61D 19/00*** | (2006.01) |
| ***E05F 15/635*** | (2015.01) |

(52) U.S. Cl.
CPC ..... *E05F 15/659* (2015.01); *B61D 19/005* (2013.01); *E05F 15/635* (2015.01); *E05Y 2201/22* (2013.01); *E05Y 2400/354* (2013.01); *E05Y 2400/36* (2013.01); *E05Y 2900/51* (2013.01); *E05Y 2900/531* (2013.01)

(58) Field of Classification Search
CPC ..... E05B 85/00; E05Y 2400/354; E05Y 2400/36; E05Y 2201/22; E05Y 2900/531; E05Y 2900/51
See application file for complete search history.

(56) References Cited

U.S. PATENT DOCUMENTS

| | | | | |
|---|---|---|---|---|
| 2001/0022049 | A1* | 9/2001 | Clark | B60J 5/06 49/360 |
| 2007/0132273 | A1* | 6/2007 | Suzuki | E05B 81/20 296/155 |
| 2013/0340346 | A1* | 12/2013 | Ueda | E05B 81/13 49/280 |
| 2016/0201377 | A1* | 7/2016 | Nishikibe | E05F 15/42 49/28 |
| 2017/0234050 | A1* | 8/2017 | Urase | E05D 15/0608 701/49 |

FOREIGN PATENT DOCUMENTS

| | | | | |
|---|---|---|---|---|
| JP | 2012-176708 | | 9/2012 | |
| WO | WO-2007004416 | A1 * | 1/2007 | E05F 15/646 |
| WO | 2012/120790 | | 9/2012 | |

* cited by examiner

DOOR CONTROL DEVICE

CROSS-REFERENCE TO RELATED APPLICATION

This application is a continuation application of International Application PCT/JP2017/037427 filed on Oct. 16, 2017 and designated the U.S., the entire contents of which are incorporated herein by reference.

BACKGROUND OF THE INVENTION

1. Field of the Invention

The present invention relates to a door control device.

2. Description of the Related Art

Conventionally, Patent Document 1 describes a door closing device of a sliding door in which, to the sliding door that opens and closes linearly in a frame of a car, a closing receiver and an opening receiver located in its opening direction are attached. In the door closing device, a drive protrusion of a motor that opens and closes the sliding door is located between the closing receiver and the opening receiver. In the door closed state of the sliding door, the drive protrusion and the closing receiver are in contact and a gap X between the drive protrusion and the opening receiver is kept in the door closing device. In the door closing device, a sliding door side stopper fixed to the sliding door and a fixed side stopper attached to the frame are provided, and one of the stoppers is biased so as to be able to move in and out in directions perpendicular to the opening and closing directions so as to be able to engage with the other stopper. In the door closed state, the sliding door side stopper is located in the door closing direction with a gap Y with respect to the fixed side stopper, a protrusion is provided on the motor, and by a movement Z in the opening direction of this protrusion, one of the two stoppers, which can enter and leave, is moved in the "enter" direction to release the engagement.

RELATED-ART DOCUMENTS

Patent Documents

[Patent Document 1] Japanese Laid-open Patent Publication No. H11-165635

However, Patent Document 1 does not disclose that, in a state in which sliding doors are closed while sandwiching an object between the sliding doors or between a frame and the slid door, a user can easily pull out the object.

Hence, an object is to provide a door control device with favorable pullability.

SUMMARY OF THE INVENTION

A door control device according to an embodiment of the present invention includes: an electric motor control unit configured to drive, in response to a closing command for closing a door that is driven to be opened and closed by an electric motor, the electric motor; a door closed state detection unit configured to detect a closed state of the door; and a lock command output unit configured to output a lock command to lock a locking device of the door, upon the closed state being detected when a predetermined waiting time has passed after the electric motor was driven by the electric motor control unit in response to the closing command and the closed state was detected by the door closed state detection unit.

It is possible to provide a door control device with favorable pullability.

DESCRIPTION OF EMBODIMENT

In the following, an embodiment in which a door control device according to the present invention is applied will be described.

Embodiment

Figure 1:
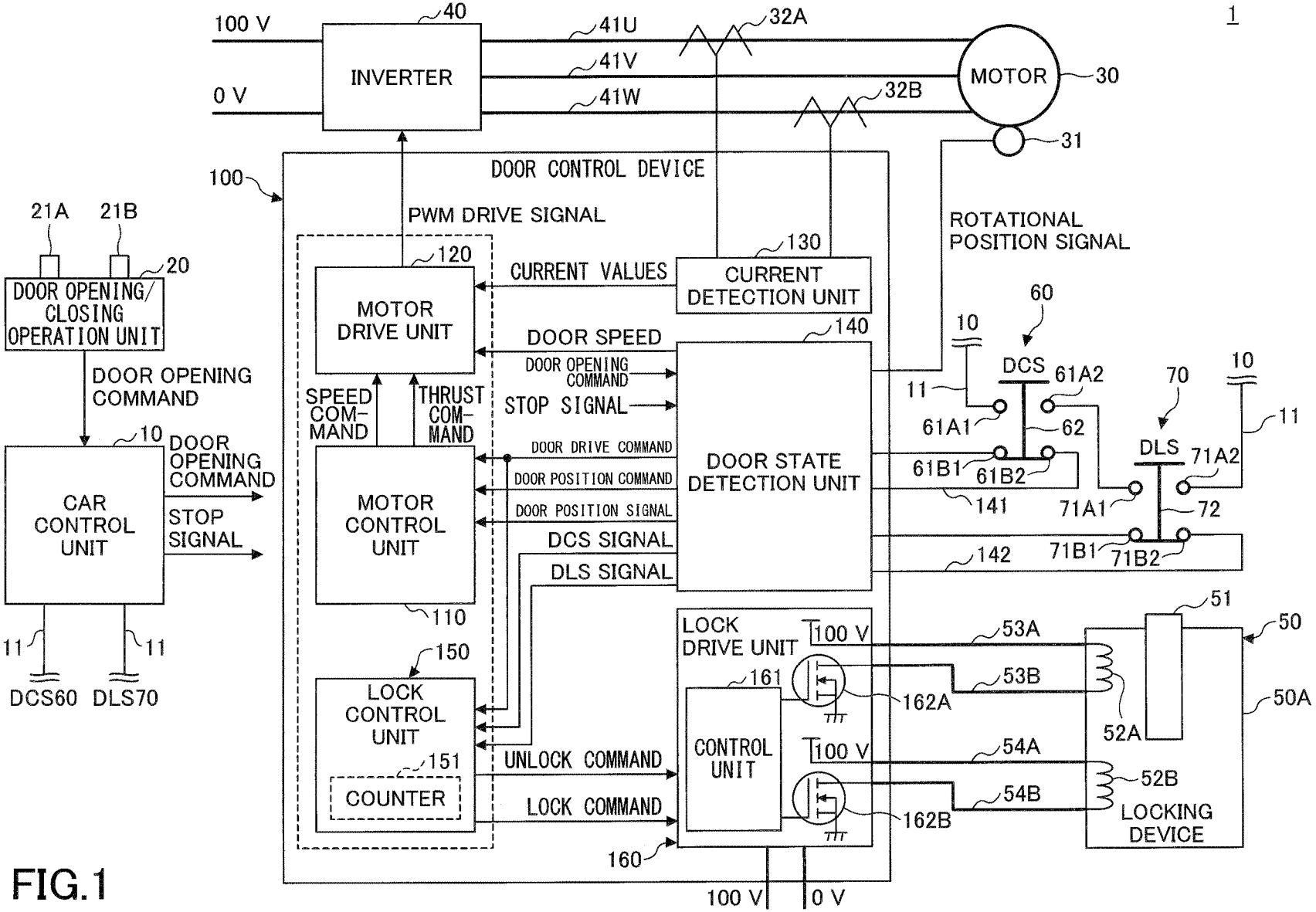
FIG. 1 is a diagram illustrating a circuit configuration of a door device of a car 1.

FIG. 1 is a diagram illustrating a circuit configuration of a door device of a car 1. Here, the car 1 is a train car that is operated by a railroad company or the like, and includes a door driven by a motor 30. The train is not limited to an electric train as long as the train includes one or more doors that are driven by the motor 30. In FIG. 1, a configuration relating to an opening/closing operation and an opening/closing control of a door is illustrated, and the illustration of the door is omitted.

The car 1 includes a car control unit 10, a door opening/closing operation unit 20, a motor 30, an encoder 31, current sensors 32A and 32B, an inverter 40, a locking device 50, a Door Close Switch (DCS) 60, a Door Lock Switch (DLS) 70, and a door control device 100.

The car control unit 10 is an information processing device that controls an operation of the car 1. In a case in which a plurality of cars 1 are connected in a train, one car control unit 10 is provided for an operator's cabin of the first car 1 and one car control unit 10 is provided for a conductor's room of the last car 1. To the car control unit 10, in addition to the door opening/closing operation unit 20, an operation lever and the like used for performing an driving operation of the car 1 are connected, but these are omitted here. In a case where the car 1 is a car that can be operated as a single-car train, for example, the car control unit 10 is provided for each of an operator's cabin and a conductor's room located at both ends in the traveling direction of the car 1.

When the car 1 is stopping at a station or the like, the car control unit 10 outputs, to the door control device 100, a stop signal indicating that the car 1 is stopping. Also, the car control unit 10 outputs, to the door control device 100, a door opening command that is input from the door opening/closing operation unit 20.

Also, a wire 11 for transmitting an interlock signal is connected to the car control unit 10. The wire 11 is connected in a loop configuration to the DCS 60 and the DLS 70. In a state in which the DCS 60 and the DLS 70 are both on, the interlock signal becomes at the H (High) level, and the car 1 is allowed to run.

The door opening/closing operation unit 20 is provided with an opening switch 21A and a closing switch 21B used for opening and closing the door. Upon the opening switch 21A being operated while the car 1 is stopping, the door opening/closing operation unit 20 outputs, to the car control unit 10, a door opening command that rises to the H (High) level. Thereby, the door is opened. Also, upon the closing switch 21B being operated, the door opening/closing operation unit 20 outputs, to the car control unit 10, a door opening command that falls to the L (Low) level. Thereby, the door is closed. The door opening command that falls to the L level is an example of a closing command for closing the door.

The motor 30 is a three-phase AC motor that performs driving to open and close the door. Drive control of the motor 30 is performed by the door control device 100 via the inverter 40. The motor 30 is an example of an electric motor.

The encoder 31 detects a rotation position of the motor 30 by detecting a rotation angle of the rotation shaft of the motor 30 and outputs, to the door state detection unit 140, a rotation position signal indicating the rotation position.

The current sensors 32A and 32B are provided on the power cables 41U and 41W, and detect current values of the U-phase and W-phase currents of the three-phase AC currents supplied from the inverter 40 via the power cables 41U, 41V, and 41W to the motor 30. The current values detected by the current sensors 32A and 32B are input to the current detection unit 130.

The inverter 40 converts the DC power that is output from the power supply device mounted on the car 1 into three-phase AC power and supplies the three-phase AC power to the motor 30 via the power cables 41U, 41V, and 41W. Two power cables connected to the output side of the power supply device are connected to the input side of the inverter 40, and DC power of 100 V is supplied as an example.

The locking device 50 is a device that locks the door of the car 1. The locking device 50 includes a pin 51 and coils 52A and 52B for unlocking and locking, and is realized by a bidirectional self-holding type solenoid device. The coil 52A is connected to the lock drive unit 160 through wires 53A and 53B, and the coil 52B is connected to the lock drive unit 160 through wires 54A and 54B.

Upon the coil 52A being energized by the lock drive unit 160, the locking device 50 causes the pin 51 to protrude (extend) from the housing 50A of the locking device 50. Thereby, the lock pin of the door moves and the door is unlocked. Note that since the locking device 50 is of a self-holding type, even when the energization of the coil 52A is released, the locking device 50 is maintained in the state in which the pin 51 protrudes from the housing 50A.

Also, upon the coil 52B being energized by the lock drive unit 160, the locking device 50 draws the pin 51 into the housing 50A of the locking device 50. Thereby, the lock pin of the door moves and the door is locked. While the car 1 is traveling, the door is locked by the locking device 50. Note that since the locking device 50 is of a self-holding type, even when the energization of the coil 52B is released, the locking device 50 is maintained in the state in which the pin 51 is drawn in the housing 50A. Also, the pin 51 is not completely drawn into the inside of the housing 50A, and the tip slightly protrudes from the housing 50A.

The DCS 60 is a switch that detects that the door of the car 1 is closed. For example, the DCS 60 is constituted by a limit switch that is pressed by the door upon the door moving to a close position.

The DCS 60 includes terminals 61A1, 61A2, 61B1 and 61B2 and a movable contact 62. The terminals 61A1 and 61A2 are inserted in series with the wire 11 that transmits an interlock signal to the car control unit 10. The terminals 61B1 and 61B2 are inserted in series with the wire 141 that transmits, to the door state detection unit 140, a signal indicating the on/off state of the DCS 60.

The movable contact 62 moves in the vertical direction in the drawing so as to conduct either the terminals 61A1 and 61A2 or the terminals 61B1 and 61B2. Upon the limit switch being pressed by the door, the DCS 60 is turned on with the terminals 61A1 and 61A2 being conducted by the movable contact 62. When the limit switch is not being pressed by the door, as illustrated in FIG. 1, the DCS 60 is turned off with the terminals 61B1 and 61B2 being conducted by the movable contact 62. The DCS 60 being on indicates that the door is completely closed.

The DLS 70 is a switch that detects that the door of the car 1 is locked. The DLS 70 is constituted by a limit switch that is pressed by the lock pin of the door, upon the pin 51 of the locking device 50 being drawn into the housing 50A and the lock pin moving to a lock position.

The DLS 70 includes terminals 71A1, 71A2, 71B1, 71B2 and a movable contact 72. The terminals 71A and 71A2 are inserted in series with the wire 11 that transmits an interlock signal to the car control unit 10. The terminals 71B1 and 71B2 are inserted in series with a wire 142 that transmits, to the door state detection unit 140, a signal indicating the on/off state of the DLS 70.

The movable contact 72 moves in the vertical direction in the drawing so as to conduct either the terminals 71A1 and 71A2 or the terminals 71B1 and 71B2. Upon the limit switch being pressed by the door, the DCS 70 is turned on with the terminals 71A1 and 71A2 being conducted by the movable contact 72. When the limit switch is not being pressed by the door, as illustrated in FIG. 1, the DCS 70 is turned off with the terminals 71B1 and 71B2 being conducted by the movable contact 72.

In a state in which the pin 51 of the locking device 50 protrudes from the housing 50A, the DLS 70 is in the off state without detecting the locking of the door. Upon the pin 51 of the locking device 50 being drawn into the housing 50A and the door being locked, the DLS 70 is turned on.

Note that the interlock signal becomes at the H level upon the DCS 60 being turned on (that is, upon the door being closed) and upon the DLS 70 being turned on (that is, upon the door being locked).

The door control device 100 includes a motor control unit 110, a motor drive unit 120, a current detection unit 130, a door state detection unit 140, a lock control unit 150, and a lock drive unit 160. The motor control unit 110, the motor drive unit 120, and the lock control unit 150 enclosed by broken line can be realized by an information processing unit such as a CPU (Central Processing Unit) chip, for example.

Based on a door drive command and a door position command input from the door state detection unit 140, the motor control unit 110 generates a speed command and a thrust command for driving the motor 30. The speed command and the thrust command are output to the motor drive unit 120. The door drive command indicates a speed at which the motor is to be driven and indicates whether to drive the motor 30 in the direction of opening the door or in the direction of closing the door. The motor control unit 110 determines, in accordance with the door drive command, the direction and the speed pattern for rotating the motor 30.

The speed command is a command to control the motor 30 by a speed, which is set to a high speed when the door is started to close, and is set to a low speed when the door is closed to a certain extent. Switching between the high speed and the low speed of the speed command is performed by the motor control unit 110 in accordance with a position of the door that is indicated by a door position signal that will be described later below.

The thrust command indicates an upper limit value of the thrust generated in the door when opening and closing the door. The door control device 100 performs drive control so that the thrust of the door is equal to or less than the upper limit value indicated by the thrust command. The thrust command is set to a large value after the door is started to close and before the door is completely closed, and is set to a small value upon the door is completely closed. The large value is, for example, 500 N, and the small value is a predetermined thrust force to the extent that a user can pull out an object sandwiched by the door.

The motor drive unit 120 generates, based on the speed command and the thrust command that are input from the motor control unit 110, based on the current values that are input from the current detection unit 130, and based on the door speed that is input from the door state detection unit 140, a PWM (Pulse Width Modulation) drive signal for driving the motor 30, and outputs the generated signal to the inverter 40.

When driving the motor 30 by a speed command, the duty cycle of the PWM driving signal is set so that the speed indicated by the speed command is equal to the door speed. When driving the motor 30 by a thrust command, the duty cycle of the PWM driving signal is set so that the thrust indicated by the thrust command is equal to the thrust of the motor 30 obtained by the current values.

The current detection unit 130 outputs data indicating the current values that are detected by the current sensors 32A and 32B to the motor drive unit 120. In FIG. 1, although the data indicating the current values is indicated by a single line, the data indicating the current value detected by the current sensor 32A and the data indicating the current value detected by the current sensor 32B are separately output to the motor drive unit 120.

The door state detection unit 140 generates a door drive command that is indicated by a logical disjunction of a door opening command and a stop signal that are input from the car control unit 10, and outputs the door drive command to the motor control unit 110. The door drive command indicates a speed at which the motor 30 is to be driven and indicates whether to drive the motor 30 in the direction of opening the door or in the direction of closing the door.

Also, the door state detection unit 140 converts a rotational position of the motor 30 that is input from the encoder 31 into a position in the opening/closing direction of the door, and outputs a door position signal indicating the position of the door to the motor control unit 110.

Also, the door state detection unit 140 detects the on/off states of the DCS 60 and the DLS via the wires 141 and 142. The door state detection unit 140 outputs a DCS signal at the L (Low) level when the DCS 60 is off, and outputs a DCS signal at the H (High) level when the DCS 60 is on. The DCS signal is input to the lock control unit 150.

Also, the door state detection unit 140 outputs a DLS signal at the L (Low) level when the DLS 70 is off, and outputs a DLS signal at the H (High) level when the DLS 70 is on. The DLS signal is input to the lock control unit 150.

The lock control unit 150 includes a counter 151, and receives the door drive command, the DCS signal, and the DLS signal that are input from the door state detection unit 140. Upon receiving a door drive command indicating closing of the door as an input, the counter 151 counts the time during which the DCS signal is held at the H (High) level after the DCS signal becomes at the H level. Upon the time counted by the counter 151 reaching 0.5 seconds, the lock control unit 150 outputs a lock command to the lock drive unit 160. As a result, the locking device 50 is locked by the lock drive unit 160.

Also, upon receiving a door drive command indicating opening of the door as an input, the lock control unit 150 outputs an unlock command to the locking device 50. As a result, the locking device 50 is unlocked by the lock drive unit 160.

The lock drive unit 160 includes a control unit 161 and MOSFETs (Metal Oxide Semiconductor Field Effect Transistors) 162A and 162B. Wires 53A, 53B, 54A, and 54B are connected to the output terminal of the lock drive unit 160. Similarly to the inverter 40, for example, 100 V of DC power is supplied to the lock drive unit 160, and the lock drive unit 160 supplies 100 V of electric power to the wires 53A and 54A.

The MOSFET 162A is an N-channel type MOSFET, of which the gate is connected to the control unit 161, the drain is connected to the wire 53B, and the source is grounded. Similarly, the MOSFET 162B is an N-channel type MOSFET, of which the gate is connected to the control unit 161, the drain is connected to the wire 54B, and the source is grounded.

The lock drive unit 160 drives the MOSFETs 162A and 162B based on the unlock command and the lock command that are input from the lock control unit 150. Upon the unlock command becoming at the H level, the lock drive unit 160 turns on the MOSFET 162A. As a result, the coil 52A of the locking device 50 is energized, the pin 51 protrudes, and the locking device 50 is unlocked. Upon the lock command becoming at the H level, the lock drive unit 160 turns on the MOSFET 162B. As a result, the coil 52B of the locking device 50 is energized, the pin 51 is withdrawn, and the locking device 50 is locked.

Figure 2A:
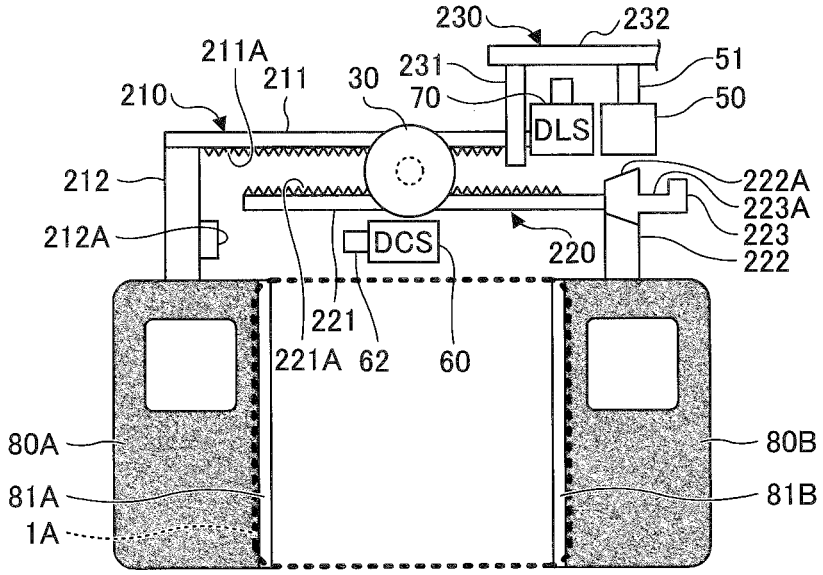
FIGS. 2A and 2B are diagrams illustrating configurations and operations of doors 80A and 80B and their peripheries of the car 1.

FIGS. 2A and 2B and FIGS. 3A to 3C are diagrams illustrating configurations and operations of doors 80A and 80B and their peripheries of the car 1. First, the configurations of respective parts will be described with reference to FIG. 2A. FIG. 2A illustrates a state in which the doors 80A and 80B are fully opened (in the fully opened state) and the locking device 50 is unlocked.

The doors 80A and 80B are double-opening type sliding doors provided in an opening lA of the car 1. The doors 80A and 80B respectively include door edge rubbers 81A and 81B at portions that come into contact with each other. The door edge rubbers 81A and 81B are attached between the lower end and the upper end at the joint portion of the doors 80A and 80B respectively. The motor 30 is provided above the doors 80A and 80B. The DCS 60 is provided under the motor 30.

An upper rack 210 is attached to the door 80A, and a lower rack 220 is attached to the door 80B.

The upper rack 210 is an L-shaped member that includes a rack portion 211 and a connection portion 212. The rack portion 211 is a bar-shaped member extending in the horizontal direction, and a rack 211A is provided on the lower surface of the upper rack portion 211. The rack portion 211 and the connection portion 212 are connected in an L shape. Therefore, upon rotating the motor 30, the upper rack 210 is moved to the right or the left, and the door 80A moves in the closing direction (right) or the opening direction (left).

The rack 211A is engaged with a pinion gear that is driven by the motor 30. The connection portion 212 is a bar-shaped member that connects the upper rack 210 to the upper end of the door 80A. A contact portion 212A is provided on the lower side surface (the right side surface in FIG. 2) of the connection portion 212. Upon the doors 80A and 80B being closed, the contact portion 212A comes into contact with the movable contact 62 of the DCS 60 and presses the movable contact 62. Thereby, the DCS 60 is turned on.

The lower rack 220 includes a rack portion 221, a connection portion 222, and an extension portion 223, and is a member attached to the door 80B. The rack portion 221 is a bar-shaped member extending in the horizontal direction, and the rack 221A is provided on the upper surface of the rack portion 221. The rack 221A is engaged with the pinion gear that is driven by the motor 30. Therefore, upon rotating the motor 30, the lower rack 220 is moved to the right or the left, and the door 80B moves in the opening direction (right) or the closing direction (left).

The connection portion 222 is a bar-shaped member that connects the lower rack 220 to the upper end of the door 80B, and includes an inclined portion 222A at the upper end. The extension portion 223 is a portion extending in the horizontal direction on the side opposite to the rack portion 221 with respect to the connection portion 222, and extends in the horizontal direction as the rack portion 221 extends. On the upper surface of the extension portion 223, a rack is not provided, and a lock hole 223A is provided.

The lock hole 223A is a recessed portion formed so as to be recessed downward from the upper surface of the extension portion 223. When locking the doors 80A and 80B, the lower end of a pin portion 231 of the lock pin 230 is inserted into the lock hole 223A.

The lock pin 230 includes the pin portion 231 extending in the vertical direction and an extension portion 232 connected to the upper portion of the pin portion 231 and extending in the horizontal direction. With respect to the lock pin 230, when the locking device 50 is unlocked and the pin 51 protrudes upward, the extension portion 232 is lifted upward. In this state, the lower end of the pin portion 231 is located above the inclined portion 222A and does not engage with the lock hole 223A. Since the lower end of the pin portion 231 is located above the inclined portion 222A, the doors 80A and 80B are in a state of being able to move in the left-right directions (opening and closing directions).

In a state in which the doors 80A and 80B are completely closed, upon the locking device 50 being locked and the pin 51 being drawn, the extension portion 232 is lowered and the lower end of the pin portion 231 engages with the lock hole 223A. Thereby, the doors 80A and 80B are locked.

Next, as operation from the state in which the locking device 50 is unlocked and the doors 80A and 80B are fully opened (fully opened state) as illustrated in FIG. 2A to gradually close the doors 80A and 80B as illustrated in FIG. 2B, FIGS. 3A, 3B, and 3C will be described.

Figure 2B:
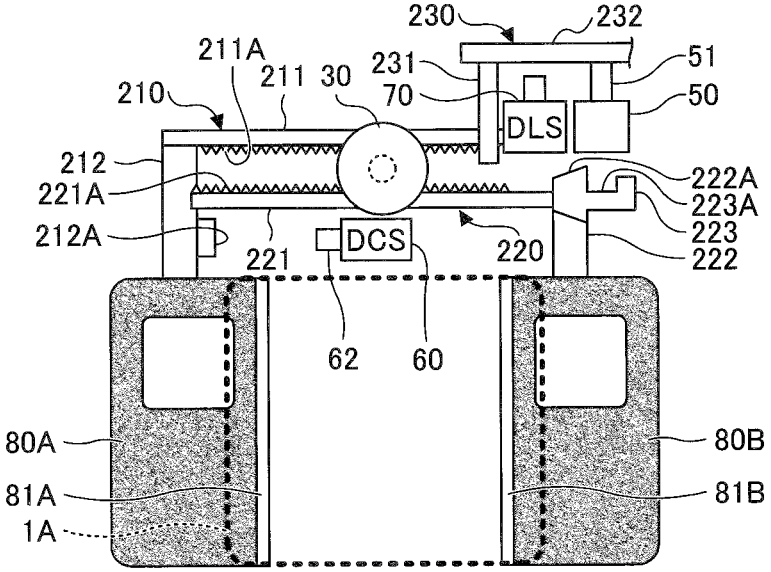
Figure 3A:
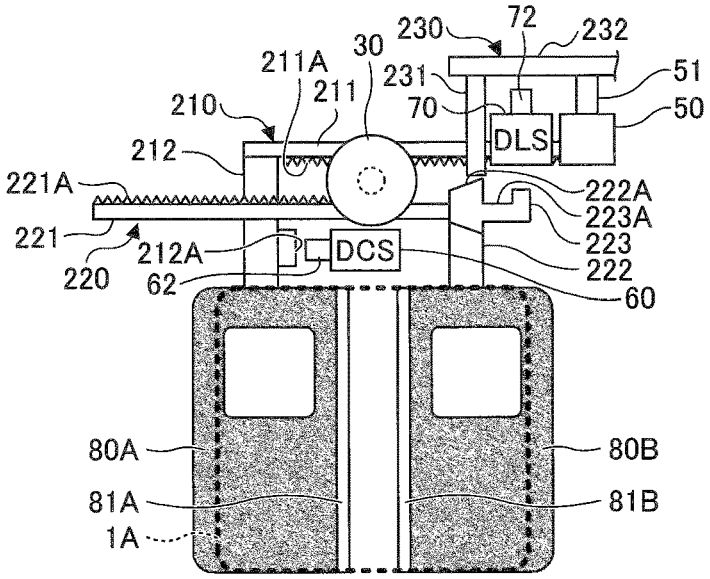
FIGS. 3A to 3C are diagrams illustrating configurations and operations of the doors 80A and 80B and their peripheries of the car 1.
Figure 3B:
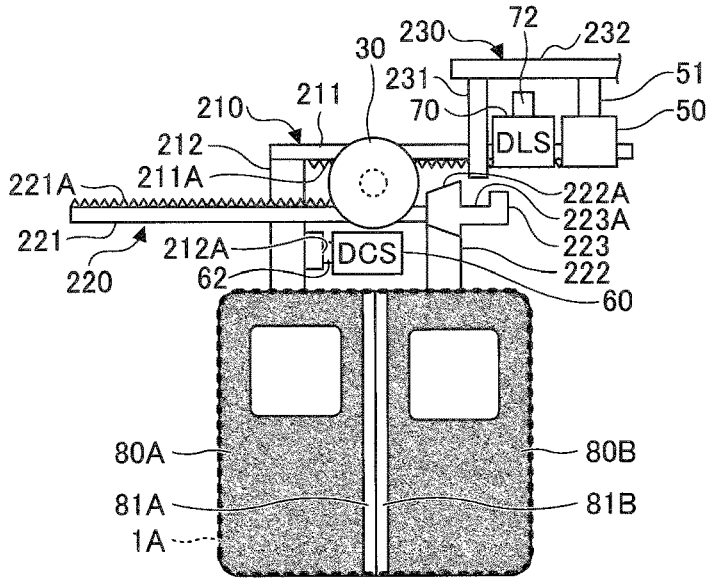

When the doors 80A and 80B are gradually closed from the state in which the doors 80A and 80B are fully opened illustrated in FIG. 2A by rotating the motor 30 in the direction of closing the doors 80A and 80B, the doors 80A and 80B are closed as illustrated in FIG. 3B through the states illustrated in FIG. 2B and FIG. 3A.

In the states illustrated in FIG. 2B and FIG. 3A, the DCS 60 and the DLS 70 are both off. As illustrated in FIG. 3B, upon the doors 80A and 80B being completely closed, the contact portion 212A comes into contact with the movable contact 62 of the DCS 60, the movable contact 62 is pressed, and the DCS 60 is turned on. However, in the state of FIG. 3B, the locking device 50 is in the unlocked state, and the DLS 70 is off.

In the state of FIG. 3B (in the state in which the DCS 60 is on and the DLS 70 is off), the door control device 100 drives the motor 30 in the direction of closing the doors 80A and 80B to press the doors 80A and 80B each other, and waits for 0.5 seconds after the DCS 60 is turned on. Here, 0.5 seconds are an example of a predetermined waiting time.

The doors 80A and 80B are suspended at their upper sides. When closing, due to an inertial force acting on the doors 80A and 80B, a delay occurs in the upper sides and the doors 80A and 80B incline. Before this inclination disappears, it takes a time for the inertial force acting on the doors 80A and 80B to become substantially zero.

Also, in a state in which the door edge rubbers 81A and 81B are in contact with each other, the driving force of the motor 30 is kept constant to keep the doors 80A and 80B in a closed state. However, a predetermined time is required from when the doors 80A and 80B are closed and the DCS 60 is turned on to when the thrust for closing the doors 80A and 80B becomes stable at a predetermined command value.

In consideration of the time required for the inertial force acting on the doors 80A and 80B to become substantially zero and the time required for the thrust of the doors 80A and 80B to become stable at a predetermined command value, the door control device 100 waits for 0.5 seconds (waiting time) in the state illustrated in FIG. 3B.

Also, upon the DCS 60 being turned on, the door control device 100 switches the drive command used for driving the motor 30 from the speed command to the thrust command. At the time of the speed command, the thrust command indicating the thrust limit value is set to 500 N, the doors 80A and 80B are closed at high speed at the beginning of closing, and the speed is decreased immediately before closing. However, upon the DCS 60 being turned on, it is decreased to a predetermined thrust to the extent that a user can pull out an object sandwiched by the doors 80A and 80B.

Figure 3C:
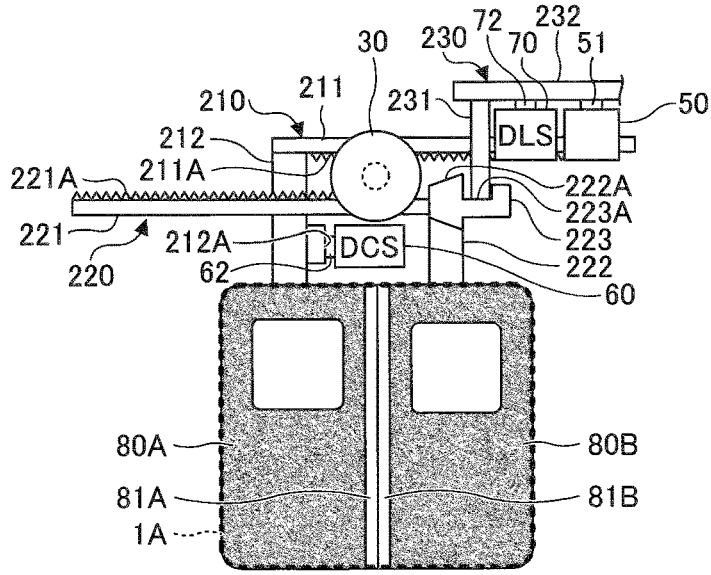

Then, when 0.5 seconds have passed after the DCS 60 was turned on, the locking device 50 is locked as illustrated in FIG. 3C. Upon the locking device 50 being locked, the pin 51 is drawn into the housing 50A, the lock pin 230 lowers, the movable contact 72 of the DLS 70 is pressed, and the DLS 70 is turned on.

As described above, during the waiting time, in the state in which the locking device 50 is unlocked without being locked, the doors 80A and 80B are held in the closed state by the driving force of motor 30 that is relatively small.

Therefore, when the doors 80A and 80B are closed, even if an object (for example, a personal item such as a user's bag or an umbrella) is sandwiched between the door edge rubbers 81A and 81B, a user can relatively easily pull out the object.

Also, because the locking device 50 is kept in a state of being unlocked without being locked, even when the doors 80A and 80B are opened again and the DCS 60 is turned off before the elapse of the waiting time, the locking device 50 can be locked by waiting the elapse of the waiting time of 0.5 seconds again. Therefore, it is possible to start the car 1 quickly at a rush hour or the like and to suppress a delay of a schedule.

Figure 4:
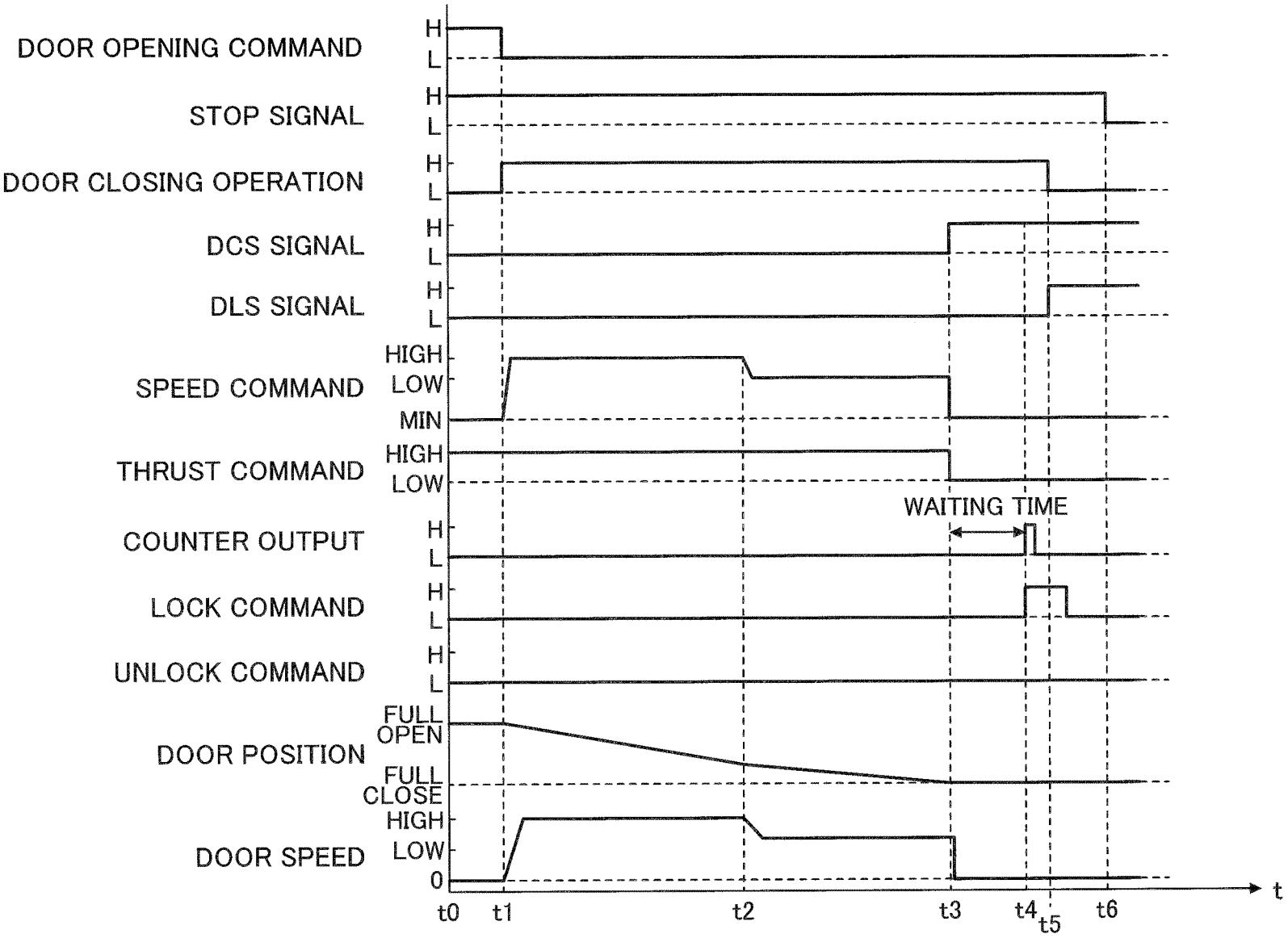
FIG. 4 is a timing chart illustrating an operation that is performed by a door control device 100 to close the doors 80A and 80B.
Figure 5:
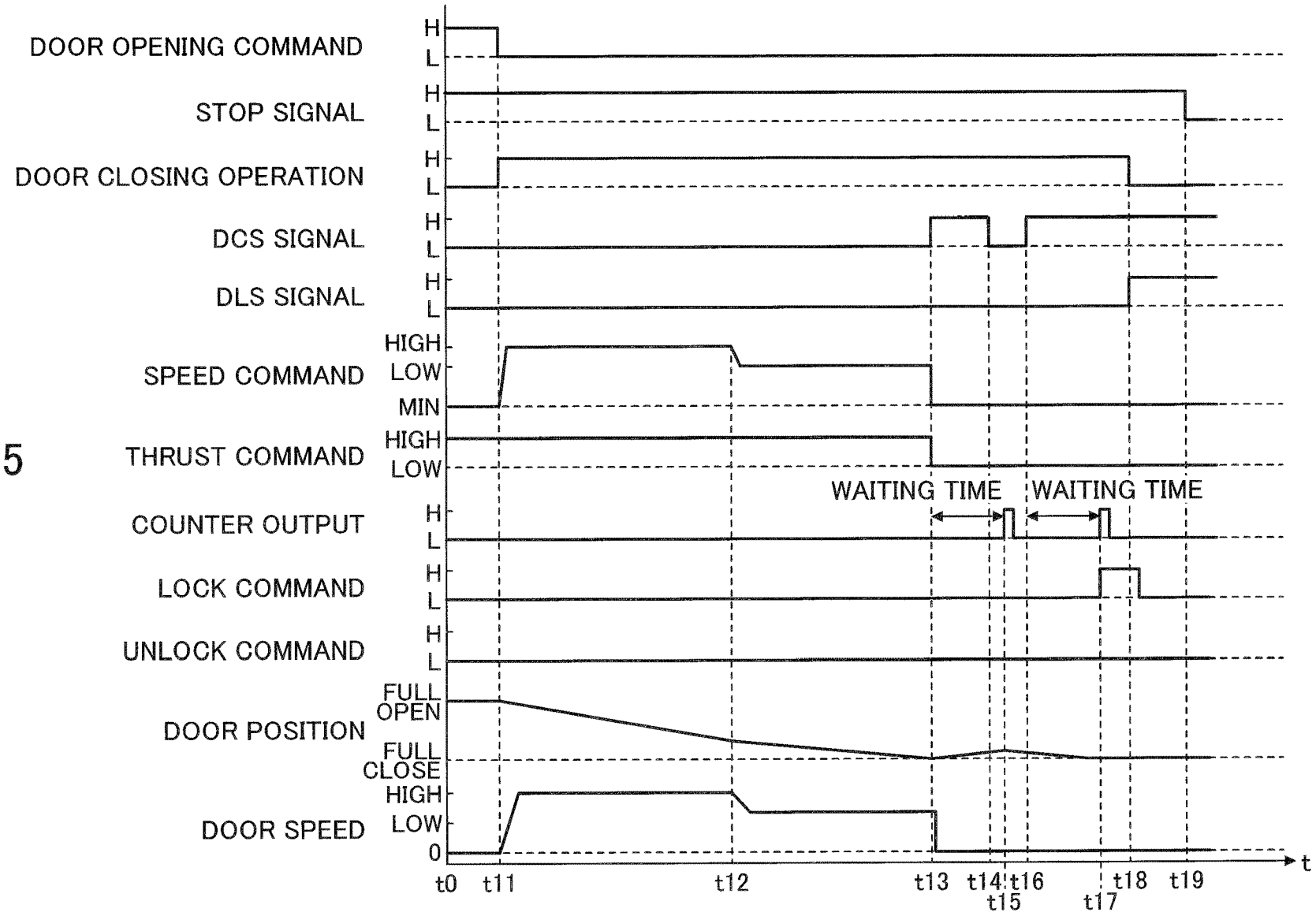
FIG. 5 is a timing chart illustrating an operation that is performed by the door control device 100 to close the doors 80A and 80B.
Figure 6:
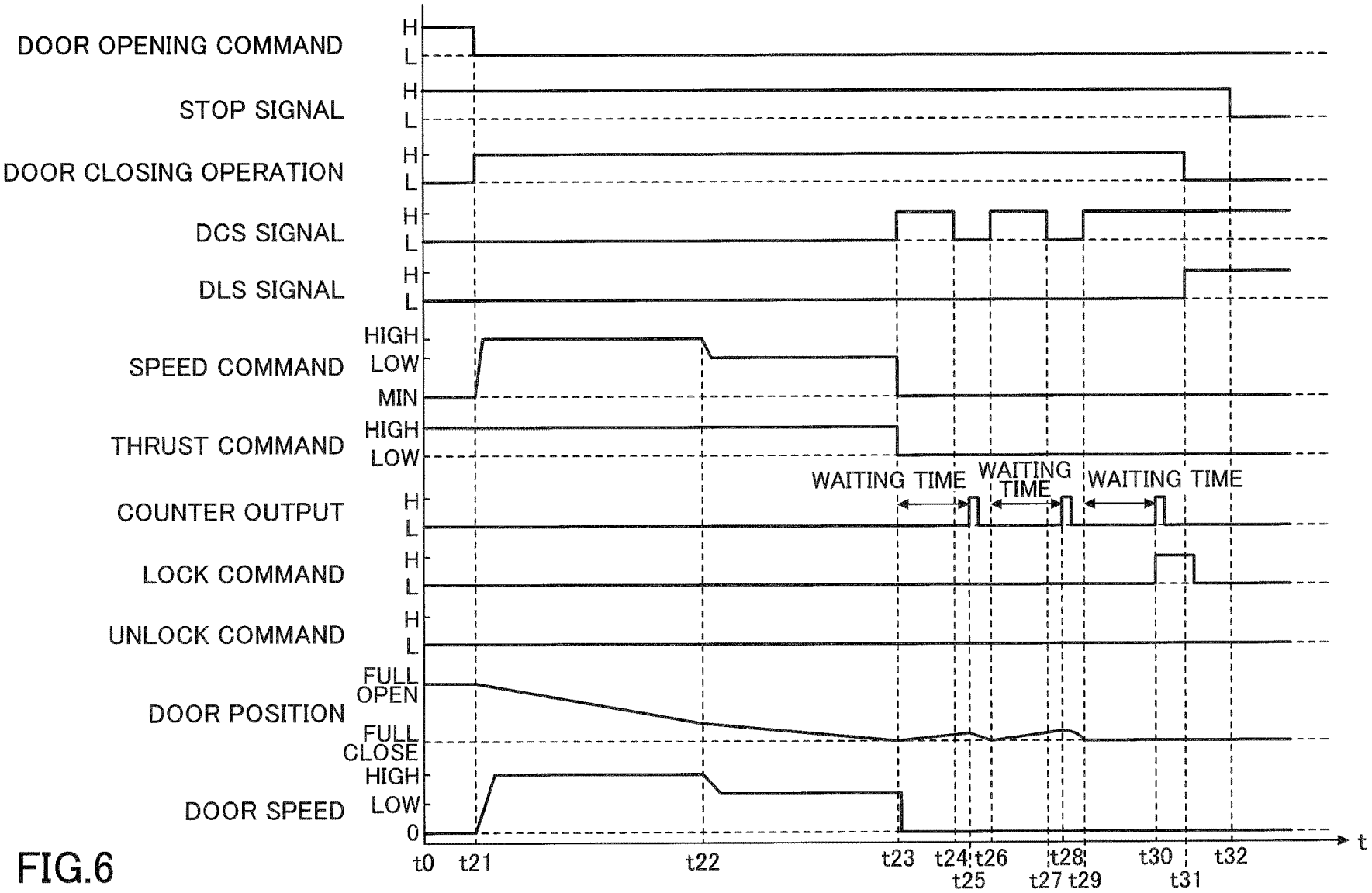
FIG. 6 is a timing chart illustrating an operation that is performed by the door control device 100 to close the doors 80A and 80B.

FIG. 4 to FIG. 6 are timing charts illustrating operations that are performed by the door control device 100 to close the doors 80A and 80B. In FIG. 4 to FIG. 6, the horizontal axis indicates time. In FIG. 4 to FIG. 6, for the vertical axis, a door opening command, a stop signal, a door closing operation, a DSC signal, a DLS signal, a speed command, a thrust command, a counter output, a lock command, an unlock command, a door position, and a door speed are indicated.

With respect to the door opening command, a rise to the H level is a door opening command to open door, and a fall to the L level is a door opening command to close the door. The stop signal is at the H level when the car 1 is stopping, and the stop signal is at the L level when the car 1 is traveling. The door closing operation is at the H level after the door opening command becomes at the L level and before the DLS signal becomes at the H level. At the other times, the door closing operation is at the L level.

In the DSC signal, the H level indicates that the DCS 60 is being turned on, and the L level indicates that the DCS 60 is being turned off. In the DLS signal, the H level indicates that the DLS is being turned on, and the L level indicates that the DLS 70 is being turned off.

The speed command is set to a high speed (HIGH) at the beginning of closing the door, set to a low speed (LOW) when the door is closed to a certain extent, and set to a minimum value (MIN) when the motor 30 is driven by the thrust command.

The thrust command is set to a large value after the door is started to close and before the door is completely closed, and is set to a small value when the door is completely closed. The large value is, for example, 500 N, and the small value is a predetermined thrust force to the extent that a user can pull out an object sandwiched by the door. Note that the level indicated by the broken line below the small value is zero. The counter output indicates an H level pulse signal that is output from the counter 151 when the time counted by the counter 151 has reached the waiting time of 0.5 seconds.

A rise to the H level of the lock command indicates a lock command to lock from the unlocked state. The H level pulse of the lock command falls to the L level after an elapse of a predetermined time. The fall to the L level does not indicate a command to the lock drive unit 160. A rise to the H level of the unlock command indicates an unlock command to unlock from the locked state.

The door position indicates a position of the doors 80A and 80B between the fully opened position and the fully closed position. The door speed indicates an actual door speed when the doors 80A and 80B close.

FIG. 4 is a timing chart in a case where the doors 80A and 80B are not forcibly opened during a door closing operation.

As illustrated in FIG. 4, at time to, while the car 1 is stopped, the doors 80A and 80B are at the fully opened position, and the locking device 50 is unlocked. Therefore, at time t0, the door opening command is at the H level, the stop signal is at the H level, the door closing operation is at the L level, the DSC signal is at the L level, the DLS signal is at the L level, the speed command is at MIN, the thrust command is at HIGH, the counter output is at the L level, the lock command is at the L level, the unlock command is at the L level, the door position is at FULL OPEN, and the door speed is 0.

At time t1, the door opening command falls to the L level, the door closing operation becomes at the H level, the speed command rises towards HIGH, the door position starts moving from FULL OPEN in the closing direction, the door speed rises with a delay with respect to the speed command.

At time t2, the speed command is switched from HIGH to LOW in accordance with the position of the doors 80A and 80B, and the door speed starts to decrease with a delay with respect to the speed command.

At time t3, by the doors 80A and 80B being closed, the DCS signal is turned on. Further, in accordance with the DCS signal being turned on, the speed command decreases to MIN and the thrust command decreases to LOW. This indicates that the driving of the motor 30 is switched from the speed command to the thrust command. Also, by the DCS signal being turned on, the counter 151 of the lock control unit 150 starts counting the waiting time. Also, the door position is fully closed, and the door speed lowers to 0 with a slight delay with respect to time t3.

At time t4, the waiting time is reached, an H level pulse is generated at the counter output, and the lock command rises to the H level. Note that the time from time t3 to time t4 is 0.5 seconds.

At time t5, the DLS signal rises to the H level, and the door closing operation falls to the L level. The rise of the DLS signal to the H level is an operation caused by the rise of the lock command to the H level at time t4.

At time t6, the stop signal falls to the L level. That is, the car 1 departs.

FIG. 5 is a timing chart in a case where the doors 80A and 80B are forcibly opened once during a door closing operation. The state at time t0 illustrated in FIG. 5 is the same as the state at time t0 illustrated in FIG. 4. Also, the state from time t11 to time t13 in FIG. 5 is the same as the state from time t1 to time t3 illustrated in FIG. 4.

At time t14, the DCS signal becomes at the L level before reaching the waiting time. This corresponds to a case where the doors 80A and 80B are forcibly opened to the extent that the DCS 60 is turned off, for example. Note that the waiting time is up to time t15, and at time t15, an H level pulse is generated at the counter output.

At time t16, the forcibly opened state of the doors 80A and 80B is released, the DCS signal again rises to the H level, and the counter 151 starts counting. Note that when the counter 151 counts again, the count time is reset.

At time t17, the waiting time is reached, an H level pulse is generated at the counter output, and the lock command rises to the H level. Note that the time from time t16 to time t17 is 0.5 seconds.

At time t18, the DLS signal rises to the H level, and the door closing operation falls to the L level. The rise of the DLS signal to the H level is an operation caused by the rise of the lock command to the H level at time t17.

At time t19, the stop signal falls to the L level. That is, the car 1 departs.

FIG. 6 is a timing chart in a case where the doors 80A and 80B are forcibly opened twice during a door closing operation.

The operation from time t0 to time t26 illustrated in FIG. 6 is the same as the operation from time t0 to time t16 illustrated in FIG. 5.

At time t27, the DCS signal again becomes at the L level before reaching the second waiting time. Note that the waiting time is up to time t28, and at time t28, an H level pulse is generated at the counter output.

At time t29, the doors 80A and 80B are forcibly opened, the DCS signal again rises to the H level, and the counter 151 starts counting. Note that when the counter 151 counts again, the count time is reset.

At time t30, the waiting time is reached, an H level pulse is generated at the counter output, and the lock command rises to the H level. Note that the time from time t29 to time t30 is 0.5 seconds.

At time t31, the DLS signal rises to the H level, and the door closing operation falls to the L level. The rise of the DLS signal to the H level is an operation caused by the rise of the lock command to the H level at time t30.

At time t32, the stop signal falls to the L level. That is, the car 1 departs.

As described above, as illustrated in FIG. 4, the locking device 50 is locked when the doors 80A and 80B are closed over the waiting time after the doors 80A and 80B were closed. Also, upon starting to count the waiting time, the driving of the motor 30 is switched from the speed command to the thrust command, and the value of the thrust command is decreased to a predetermined thrust force to the extent that a user can pull out an object sandwiched between the doors 80A and 80B.

Also, as illustrated in FIG. 5, even if the doors 80A and 80B are slightly opened during the waiting time after the doors 80A and 80B were closed, the waiting time is again counted, and the locking device 50 is locked when the doors 80A and 80B are closed over the waiting time. Also, upon starting to count the waiting time, the driving of the motor 30 is switched from the speed command to the thrust command, and the value of the thrust command is decreased to a predetermined thrust force to the extent that a user can pull out an object sandwiched between the doors 80A and 80B.

Also, as illustrated in FIG. 6, even if the doors 80A and 80B are slightly opened twice during the waiting time after the doors 80A and 80B were closed, the waiting time is again counted, and the locking device 50 is locked when the doors 80A and 80B are closed over the waiting time. Also, upon starting to count the waiting time, the driving of the motor 30 is switched from the speed command to the thrust command, and the value of the thrust command is decreased to a predetermined thrust force to the extent that a user can pull out an object sandwiched between the doors 80A and 80B.

In this way, upon closing the doors 80A and 80B, the driving of the motor 30 is switched from the control by the speed command to the control by the thrust command, and the thrust command is lowered to the extent that a user can pull out the object.

This is for a user, even if an object (for example, a personal item such as a user's bag or an umbrella) is sandwiched between the door edge rubbers 81A and 81B when closing the doors 80A and 80B, to relatively easily pull out the object.

Then, when the doors 80A and 80B are closed over the waiting time after the doors 80A and 80B have been closed, the locking device 50 locks.

Therefore, it is possible to provide the door control device 100 with favorable pullability.

Also, because the locking device 50 is kept in a state of being unlocked without being locked, even when the doors 80A and 80B are opened again and the DCS 60 is turned off before the elapse of the waiting time, the locking device 50 can be locked by waiting the elapse of the waiting time of 0.5 seconds again. Therefore, it is possible to start the car 1 quickly at a rush hour or the like and to suppress delay of a schedule.

There is a conventional door device that adopts a method of locking a locking device 50 immediately upon a DCS 60 being turned on. In such a door control device, even if a user tries to pull out an object, because doors 80A and 80B are locked by the locking device 50, there are cases in which it is difficult to pull out the object. That is, the pullability is not favorable. Also, when the doors 80A and 80B are reopened, because it is required to unlock the locking device 50, it takes a long time for a series of operations, which may cause a delay in departure.

With respect to the above, the door control device 100 according to the embodiment can achieve both favorable pullability and a quick operation.

Note that in the embodiment described above, in consideration of the time required for the inertial force acting on the doors 80A and 80B to become substantially zero and the time required for the thrust of the doors 80A and 80B to become stable at a predetermined command value, the waiting time of 0.5 seconds is set. However, the waiting time may be set in consideration of either the time required for the inertial force acting on the doors 80A and 80B to become substantially zero or the time required for the thrust of the doors 80A and 80B to become stable at a predetermined command value.

Also, although the waiting time is set to 0.5 seconds in the above description, the waiting time is not limited to 0.5 seconds. The waiting time may be set in consideration of the weight of the doors 80A and 80B, the responsiveness of the motor 30, the motor drive unit 120, and the motor control unit 110, and the like.

Also, although the thrust command is set to 500 N while the motor 30 is driven and controlled by the speed command in the embodiment described above, the thrust command is not limited to 500 N and may be set to an appropriate value. Also, while the motor 30 is driven and controlled by the speed command, a control mode by the speed command and a control mode by the thrust command may be switched without setting the value of the thrust command. Not setting a value of the thrust command is equivalent to not limiting the thrust force command to an upper limit value.

Also, although opening/closing control of the doors 80A and 80B, which are double sliding doors, is performed in the embodiment described above, instead of the doors 80A and 80B, opening/closing control of a single sliding door may be performed.

Also, although the locking device 50 is locked in a case where the DCS signal continues to be at the H level over the waiting time after the DCS signal rose to the H level in the embodiment described above, the locking device 50 may be locked as follows.

Figure 7:
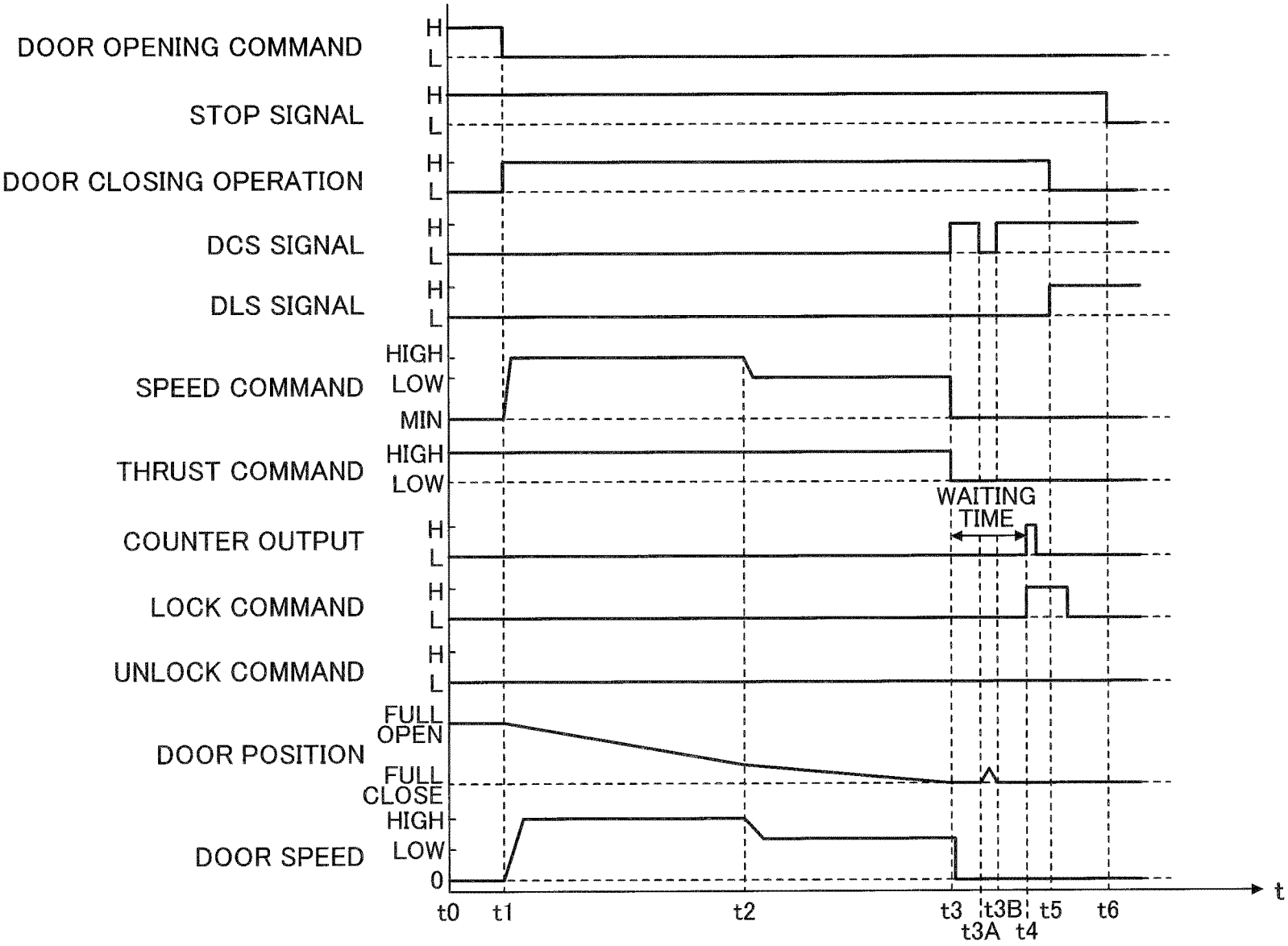
FIG. 7 is a diagram illustrating a modified example of the operation illustrated in FIG. 4.

FIG. 7 is a diagram illustrating a modified example of the operation illustrated in FIG. 4. In FIG. 7, after the DCS signal became at the H level at time t3 and before the waiting time has passed at time t4, the DCS signal has fallen to the L level from time t3A to time t3B.

In such a case, during the waiting time, when the doors 80A and 80B are momentarily opened, the amount of opening the doors 80A and 80B is very small, and when the DCS signal is at the H level again at time t4 when the waiting time elapses, locking may be performed.

In other words, the locking device 50 may be locked when the DCS signal is at the H level at a time at which the waiting time has passed after the DCS signal rose to the H level.

Although an example of a door control device according to the embodiment of the present invention has been described above, the present invention is not limited to the embodiment specifically disclosed, and various variations and modifications may be made without departing from the scope of the claims.

What is claimed is:

1. A door control device comprising:

a memory; and a processor that is coupled to the memory and that is configured to:

drive an electric motor for opening and closing a door;

detect a closed state of the door; and output a lock command to lock a locking device of the door, upon the closed state being detected at a point of time at which a predetermined waiting time has passed after the electric motor was driven in response to a closing command and the closed state was detected regardless of whether the closed state is continuously detected during the predetermined waiting time, wherein, when the closed state has been continuously maintained over the predetermined waiting time, the processor is configured to output the lock command to lock the locking device upon the closed state being detected at the point of time at which the predetermined waiting time has passed, and wherein, when the closed state of the door is momentarily changed to an opened state during the predetermined waiting time, the processor is configured to output the lock command to lock the locking device upon the closed state being detected at the point of time at which the predetermined waiting time has passed after the closed state was detected.

2. The door control device according to claim 1, wherein the processor outputs the lock command to lock the locking device of the door, upon the closed state being continuously detected over the predetermined waiting time after the closed state was detected.

3. The door control device according to claim 1, wherein, upon the closing command being output, the processor drives the electric motor by a speed command before the closed state is detected, and wherein, upon the closed state being detected, the processor drives the electric motor by a thrust command to keep the door closed, the thrust command indicating a predetermined thrust force which is smaller than thrust force while the processor drives by the electric motor by the speed command.

4. The door control device according to claim 3, wherein while the processor drives the electric motor by the speed command upon the closing command being output, thrust is limited so as not to exceed a predetermined maximum value, and wherein while the processor drives the electric motor by the thrust command, a speed is limited so as not to exceed a predetermined maximum value.

5. The door control device according to claim 1, wherein the predetermined waiting time is a time that is in consideration of a time from when the closed state is detected to when thrust of the door driven by the electric motor becomes less than or equal to a predetermined thrust and/or a time required for an inertial force of the door to become less than or equal to a predetermined inertial force.

6. The door control device according to claim 1 wherein the processor is further configured to drive the electric motor such that a speed of the door is decreased from a first speed to a second speed upon the door being closed to a certain extent and the speed of the door is decreased from the second speed to a third speed upon the closed state being detected while thrust is maintained at a first thrust and decreased to a second thrust upon the closed state being detected.

* * * * *